US005454408A

United States Patent [19]

DiBella et al.

[11] Patent Number: 5,454,408

[45] Date of Patent: Oct. 3, 1995

[54] VARIABLE-VOLUME STORAGE AND DISPENSING APPARATUS FOR COMPRESSED NATURAL GAS

[75] Inventors: Francis A. DiBella, Roslindale; Michael D. Koplow, Woburn; Richard Mastronardi, Medfield, all of Mass.

[73] Assignee: Thermo Power Corporation, Mass.

[21] Appl. No.: 105,869

[22] Filed: Aug. 11, 1993

[51] Int. Cl.[6] ..... F17C 13/02

[52] U.S. Cl. ..... 141/197; 141/18; 141/27; 141/67; 141/83; 141/47; 141/248

[58] Field of Search ..... 141/2–5, 18, 21, 141/25, 27, 47, 51, 67, 83, 95, 197, 248; 222/395; 48/190–192

[56] References Cited

U.S. PATENT DOCUMENTS

| | | | |
|---|---|---|---|
| 3,557,785 | 1/1971 | McQueen | 128/188 |
| 3,749,526 | 7/1973 | Ferrentino | 417/390 |
| 3,788,074 | 1/1974 | Castela et al. | 60/413 |
| 4,188,787 | 2/1980 | Bromell et al. | 60/327 |
| 4,337,803 | 7/1982 | Monte | 141/2 |
| 4,483,376 | 11/1984 | Bresie et al. | 141/95 |
| 4,515,516 | 5/1985 | Perrine et al. | 417/38 |
| 4,582,100 | 4/1986 | Poulsen | 141/4 |
| 4,585,039 | 4/1986 | Hamilton | 141/47 |
| 4,611,973 | 9/1986 | Birdwell | 417/342 |
| 4,651,788 | 3/1987 | Grosskreuz et al. | 141/83 |
| 4,750,869 | 6/1988 | Shipman, III | 417/342 |
| 4,898,217 | 2/1990 | Corbo et al. | 141/83 |
| 5,086,816 | 2/1992 | Mieth | 141/83 |
| 5,107,906 | 4/1992 | Swenson et al. | 141/4 X |
| 5,169,295 | 12/1992 | Stogner et al. | 417/339 |
| 5,211,021 | 5/1993 | Pierson | 141/5 X |
| 5,253,682 | 10/1993 | Haskett et al. | 141/3 |

*Primary Examiner*—J. Casimer Jacyna
*Attorney, Agent, or Firm*—Fish & Richardson

[57] ABSTRACT

A variable-volume compressed natural gas ("CNG") storage vessel connected to a line supplying pressurized natural gas is described. The vessel connects to a dispensing station having a connection head—a fitting that allows a vehicle tank quickly and easily to be interconnected with and disconnected from the dispensing station. When a vehicle tank is being filled, or alternatively when a storage vessel is being replenished from the gas supply line, a controller responds to the pressure within the storage vessel to vary the volume of that vessel.

22 Claims, 6 Drawing Sheets

VARIABLE-VOLUME STORAGE AND DISPENSING APPARATUS FOR COMPRESSED NATURAL GAS

BACKGROUND OF THE INVENTION

The present invention relates in general to compressed natural gas ("CNG") storage and dispensing systems, and more particularly concerns novel apparatus for dispensing CNG at substantially constant and easily measured mass flow rates.

In light of expanding concerns about emissions and foreign energy dependence, commercial and passenger vehicles are increasingly being designed to operate on CNG. There is a growing need, therefore, for CNG fueling stations able to resupply these vehicles. In order for CNG-fueled vehicles to have commercial appeal, not only must these stations be conveniently located, as gasoline filling stations are today, but in addition they must be able to refuel a constant stream of vehicles, each in a relatively brief period of time. Further, they must be reasonably inexpensive to install and operate. Given these considerations and the high pressures at which CNG is typically stored within a vehicle, these CNG fueling stations therefore must be specially designed.

A paramount concern of the CNG station operator is the station's "storage effectiveness," defined as the fraction of stored CNG that can be transferred, at a particular pressure, to CNG vehicle tanks. Storage effectiveness, together with compressor flow rate characteristics, determine the number of vehicles that a station can fill in a given time period. Today, storage effectiveness can be improved by increasing the CNG storage pressure, the number of "cascade" levels, or both.

In a typical cascade CNG station, empty vehicle tanks are filled first from one of a series of three conventional CNG storage tanks. If the pressures in the vehicle and first storage tanks equalize at a pressure below the maximum desired vehicle tank pressure, a sequential valve then connects the vehicle tank to a second storage tank, which contains CNG at higher pressure. If necessary, this process then repeats using a third tank. A dome valve ensures that the vehicle tank pressure does not exceed the maximum desired pressure. During filling, a priority valve determines, based on the pressures in each, which storage tank should be refilled first by the compressor. Throughout the filling operation, a mass flow sensor monitors the total amount of CNG transferred to the vehicle.

Although they greatly increase both the cost and the complexity of the station, these various valves and the gas flow rate sensor are essential to the operation of the cascade system. Even with this expense, however, the storage effectiveness still remains well below unity. Storage effectiveness can be incrementally improved in this type of system only by increasing CNG storage pressure. However, not only does this require a higher pressure compressor, but any energy used to increase storage pressure above the maximum vehicle storage pressure is necessarily lost during the filling operation. This increases the total operating cost of filling each vehicle.

Vehicle owners and station operators would also prefer to reduce the temperature rise in the vehicle tank during the filling operation. The lower the final temperature of the tank, the greater the mass of CNG that can be stored there. When filled by a cascade system, however, vehicle tanks experience considerable "compression heating."

SUMMARY OF THE INVENTION

The invention features a CNG refueling station that includes a variable-volume gas storage vessel connected to a line supplying pressurized natural gas. The vessel, or in an alternative embodiment a plurality of such vessels, connects to a dispensing station having a connection head— a fitting that allows a vehicle tank quickly and easily to be interconnected with and disconnected from the dispensing station. When a vehicle tank is being filled, or alternatively when a storage vessel is being replenished from the gas supply line, a controller in the refueling station responds to the pressure within the storage vessel to vary the volume of that vessel.

In one exemplary embodiment, a standard CNG tank connects to both a compressor supplying CNG and a pump supplying hydraulic fluid. The controller monitors the signal from a pressure sensor in the tank, causing hydraulic fluid to enter the tank when CNG pressure is to be increased, and exit when the pressure is to be decreased. In this embodiment, because hydraulic fluid directly contacts stored CNG, a fluid that beneficially interacts with the CNG can be used in the system. For instance, if a desiccant liquid is used as a hydraulic fluid, substantial amounts of water vapor contained in the stored CNG are absorbed into the liquid.

In an alternative embodiment, the CNG tank includes an impermeable, movable interface positioned so as to divide the tank into two portions. The compressor supplies CNG to one portion, and the pump hydraulic fluid to the other.

The invention, which can be incorporated into existing CNG dispensing stations, has a theoretical storage effectiveness of unity; all stored CNG can be dispensed, at any desired pressure, into vehicle tanks. Thus, more vehicles can be refueled from a given storage capacity. This high storage effectiveness is achieved without either overpressurizing the storage tanks or using a cascading mechanism. Due to this high storage effectiveness and the fact that CNG is stored in the vessels at, rather than above, the maximum vehicle tank storage pressure, a smaller and cheaper compressor unit and thinner-walled CNG tanks can be used in the system. And because the tanks in a CNG fueling station are not cascaded, expensive dome, priority, and sequential valves are unnecessary.

Nor is an expensive gas flow rate detector needed. Instead, the total volume of the CNG dispensed can be determined by monitoring the change in volume of the storage vessel. As the pressure in that vessel is the same before and after the vehicle filling operation, the total mass delivered can be easily calculated.

Not only is a system using the present invention less expensive to construct, it is cheaper to operate as well. Compressing natural gas to lower pressures consumes less energy. That compression process will also be more efficient because, when it is being filled, vessel volume can be varied to keep the pressure there constant. A compressor that functions optimally at this single pressure can therefore be utilized.

Additionally, the invention can be used to fill, with no modification, either a conventional fixed-volume or an advanced variable-volume vehicle tank. Using either type, filling occurs at a more constant, controlled rate. This minimizes the temperature increase in the vehicle tank, allowing CNG to be stored at higher densities, and thereby increasing the total mass of CNG that can be delivered during refueling.

The invention includes also a measure of built-in redundancy. Should the hydraulic pump fail, vehicle tanks can be filled directly from the compressor. Similarly, if the compressor were to fail, the hydraulic pump alone can be used to dispense all CNG stored prior to the failure.

Other advantages and features of the invention will be apparent from the following description of a preferred embodiment, and from the claims.

DESCRIPTION OF THE PREFERRED EMBODIMENT(S)

Figure 1:
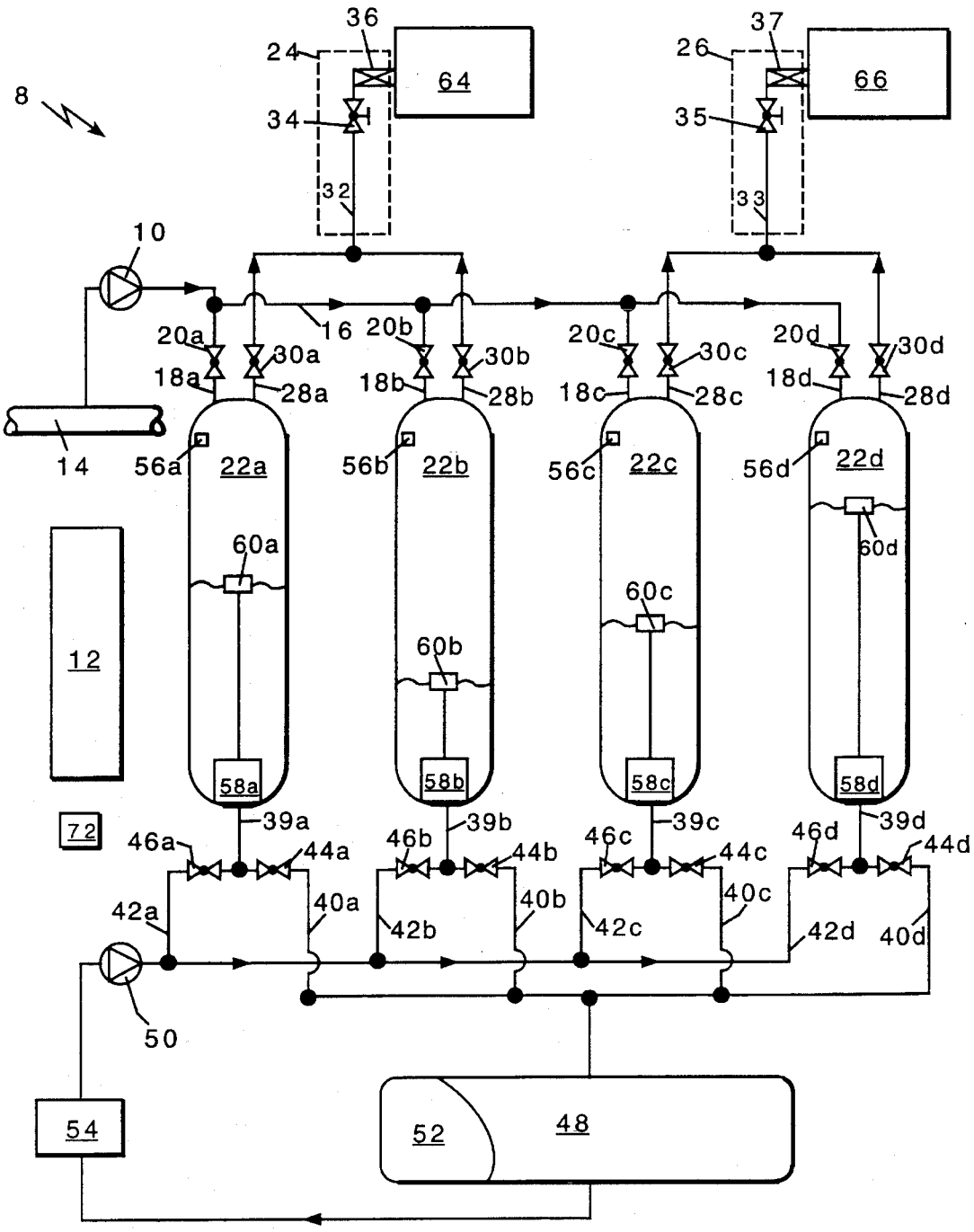
FIG. 1 is a schematic diagram of one embodiment of a variable-volume CNG storage and dispensing apparatus.

A schematic of a CNG dispensing system 8, for example for a CNG dispensing station, is shown in FIG. 1. The low pressure side of a gas compressor system 10, the operation of which is dictated by signals received from a controller 12, connects to a standard natural gas pipeline 14, readily available in most regions. The pressure of the natural gas drawn from the pipeline 14 typically fluctuates between 0 and 60 psig. The gas compressor system 10 is selected such that peak compression efficiency is realized when natural gas is compressed from this pipeline pressure to the maximum vehicle fill pressure, for example 3000 psig. For example, in one embodiment the gas compressor system 10 comprises a Sullair Model No. PDX-10 screw compressor gas booster and an Ariel Model No. JGP/2 two-stage reciprocating compressor. The screw compressor first pressurizes natural gas drawn from the pipeline 14 to 150 psig. The reciprocating compressor then further compresses the natural gas to 3000 psig, which is then delivered to a supply line 16. Using this configuration, the gas compressor system 10 can supply a maximum of 200 standard cubic feet per minute (scfm) of CNG.

The supply line 16 connects, through lines 18*a–d* each containing a computer-controlled valve 20*a–d*, to a series of storage tanks 22*a–d*. The operation of these and all other computer-controlled valves is dictated by signals generated by the controller 12. The storage tanks 22*a–d*, which for convenience may be located underground, are conventional ASME high-pressure gas and liquid storage vessels, each of which displaces 20 cubic feet (cf) of interior volume. Thus, at 3000 psig, each storage tank contains 6200 standard cubic feet (scf) of natural gas.

Each storage tank 22*a–d* communicates, through a line 28*a–d* containing a computer-controlled valve 30*a–d*, with a single dispensing station 24, 26. The storage tanks are therefore grouped into pairs 22*a,b*; 22*c,d*, each pair supplying CNG to one dispensing station 24, 26. Alternatively, a single storage tank can be used to supply one or a plurality of dispensing stations (not shown). Each dispensing station 24, 26 consists of a vehicle tank fill line 32, 33, a computer-controlled valve 34, 35, and a connection head 36, 37.

Located at the base of each storage tank 22*a–d* is a port 39*a–d* positioned to allow any fluid contained in the storage tanks 22*a–d* to be drained away. Each port 39*a–d* communicates, through separate supply and return lines 40*a–d*, 42*a–d* each including a computer-controlled valve 44*a–d*, 46*a–d*, with both a hydraulic fluid reservoir 48 and the high pressure side of a hydraulic pump 50, respectively.

Figure 2:
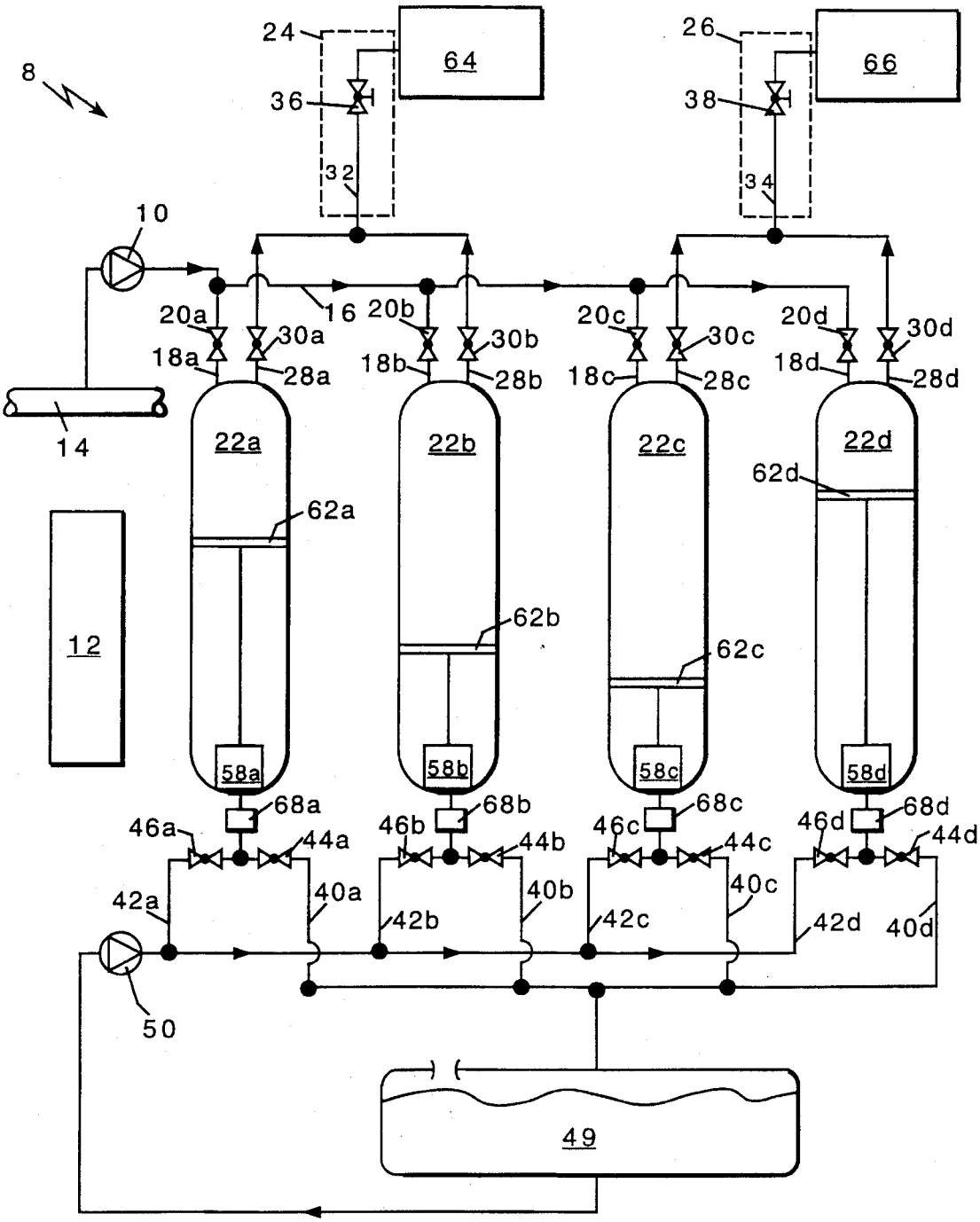
FIG. 2 is a schematic diagram of a second embodiment of a variable-volume CNG storage and dispensing apparatus.

The hydraulic fluid reservoir 48 contains a bladder 52 containing pressurized gas. As hydraulic fluid enters the reservoir 48, the bladder 52 compresses, raising the pressure of the contained gas. The bladder volume and pressure are selected such that, when the reservoir 48 contains all of the hydraulic fluid in the system, the pressure in the bladder is on the order of 5–10 psig below 3000 psig. Alternatively, as shown in FIG. 2, if a less expensive system is desired, a sump-type reservoir 49 that is vented to atmosphere may be used. Since the vented reservoir 49 need not withstand significant pressures, it may be constructed from a less-substantial vessel.

Using either embodiment, the reservoir 48, 49 connects also to the low pressure side of the hydraulic pump 50. When the pump 50 operates, hydraulic fluid is drawn from the reservoir 48, 49 and delivered to the supply lines 42*a–d*. A suitable pump is available from CAT Pumps Corporation. This electric-motor driven, positive-displacement, two piston liquid pump is controlled by signals generated by the control interface 12, and delivers 5–10 gallons per minute (gpm) of hydraulic fluid at 3000 psig. Alternatively, any pump capable of supplying liquid at 3000 psig may be employed.

For hydraulic fluid, a desiccant liquid, such as ethylene glycol, methanol, or hydraulic oil, can be used. Because the hydraulic fluid comes into direct contact with the stored CNG, the two can chemically interact, and water vapor contained in the CNG can be absorbed into the hydraulic fluid. As shown in FIG. 1, the line connecting the hydraulic reservoir 48 to the pump 50 contains a fluid dryer 54 that extracts water from the hydraulic fluid flowing through it. Alternatively, the hydraulic fluid can be periodically removed from the station and replaced or reprocessed to remove any absorbed water.

Figure 6:
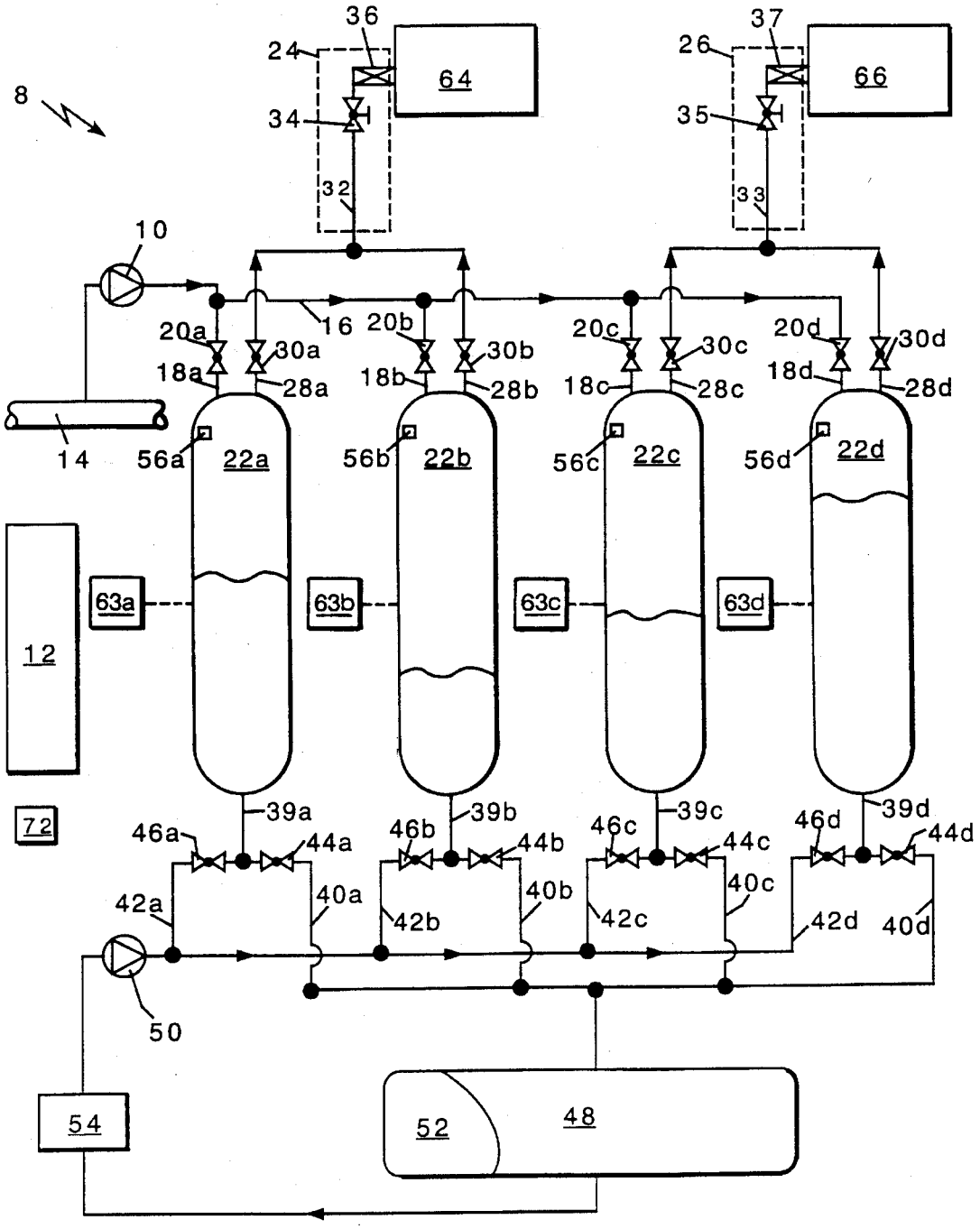
FIG. 6 is a schematic diagram of a fourth embodiments of a variable-volume CNG storage and dispensing apparatus.

Each storage tank includes both a pressure sensor 56*a–d* and a sealed, level-indicating potentiometer 58*a–d* connected to a float 60*a–d*. The floats 60*a–d* rise and fall with the level of the hydraulic fluid in the storage tanks 22*a–d*, causing proportional variations in the signal generated by the potentiometers 58*a–d*. Alternatively, the positions of the CNG-hydraulic fluid interfaces can be measured using sonic linear transducers (not shown), or by weighing each storage tank by monitoring a weighing device 63*a–d* (shown schematically in FIG. 6) coupled to each tank 22*a–d*. These fluid level signals and those generated by the pressure sensors 56*a–d* are communicated to the control interface 12.

The invention embraces also alternative apparatus for varying the volume of the region in which CNG is enclosed. For example, as shown in FIG. 2, included within each storage tank 22*a–d* is a liquid/gas interface 62*a–d*. These movable interfaces 62*a–d* form a seal with the interior surfaces of the storage tanks 22*a–d*, dividing each tank volume into two gas- and liquid-impermeable portions. CNG is delivered to one of these portions, and hydraulic fluid to the other. The level-sensing potentiometers 58*a–d* in the tanks connect directly to the interfaces 62*a–d*; floats are unnecessary in this configuration, and the orientation of the tanks is not critical to the functioning of the volume-varying mechanism. Also, any type of hydraulic fluid may be used, as it never comes into direct contact with stored CNG. A fluid dryer is also therefore not needed.

Operation

Initially, the storage tanks are completely filled with hydraulic fluid, and all of the computer-controlled valves are closed. Referring to either FIG. 1 or FIG. 2, to begin the replenishing operation, by which the storage tanks are fully charged with CNG, the controller 12 first issues a command to start the compressor 10 and open valve 20*a*. As CNG flows into the first storage tank 22*a*, the pressure in that tank 22*a* begins to rise. When the signal generated by the pressure sensor 56*a* in the tank 22*a* indicates a pressure greater than 3000 psig, the control interface causes valve 44*a* to open. This connects the storage tank 22*a* with the hydraulic fluid reservoir 48. Because the pressure in the storage tank 22*a* exceeds that in the reservoir 48, hydraulic fluid exits the tank 22*a* through return line 40*a*. This causes the volume of the region containing CNG to increase and the pressure in the tank 22*a* to drop. When the indicated pressure falls below 3000 psig, valve 44*a* is closed. Valve 44*a* is repeatedly opened and closed during the replenishing operation to maintain the pressure in the storage tank 22*a* at a constant 3000 psig.

When the signal from the level-sensing potentiometer 58*a* indicates that the level of the hydraulic fluid contained in the storage tank 22*a* has dropped below some predetermined level, the controller determines that the storage tank 22*a* is filled and issues a command to close valve 20*a*. Alternatively, when the storage tank 22*a* includes an interface 62*a* as shown in FIG. 2, the controller 12 can throughout the replenishing operation monitor instead the signal generated by the pressure sensor 56*a*. When the tank 22*a* is completely filled with CNG at 3000 psig, no hydraulic fluid remains that can be drained out to increase the volume of the region containing CNG. The compressor 10, however, continues to supply CNG to the tank 22*a*. When the pressure sensor 56*a* indicates a pressure in the storage tank 22*a* in excess of 3000 psig while the valve 44*a* is open, the controller 12 then determines the tank 22*a* to be filled with CNG, and causes valve 20*a* to close. Irrespective of the control scheme used to determine when the storage tank 22*a* is filled, the replenishing operation then repeats for the remaining unfilled storage tanks 22*b–d*.

The filling operation, in which CNG is delivered to a vehicle tank 64, 66, begins by connecting the vehicle tank 64, 66 to the connection head 36, 37 of either of the two dispensing stations 24, 26. When mated to a vehicle tank 64, 66, each connection head 36, 37 provides a sealed, gaseous, temporary interconnection between the vehicle tank fill line 32, 33 and the vehicle tank 64, 66. Each vehicle tank displaces 6 cf of interior volume. Thus, at 3000 psig, each vehicle tank 64, 66 contains 1150 scf of natural gas.

Figure 3:
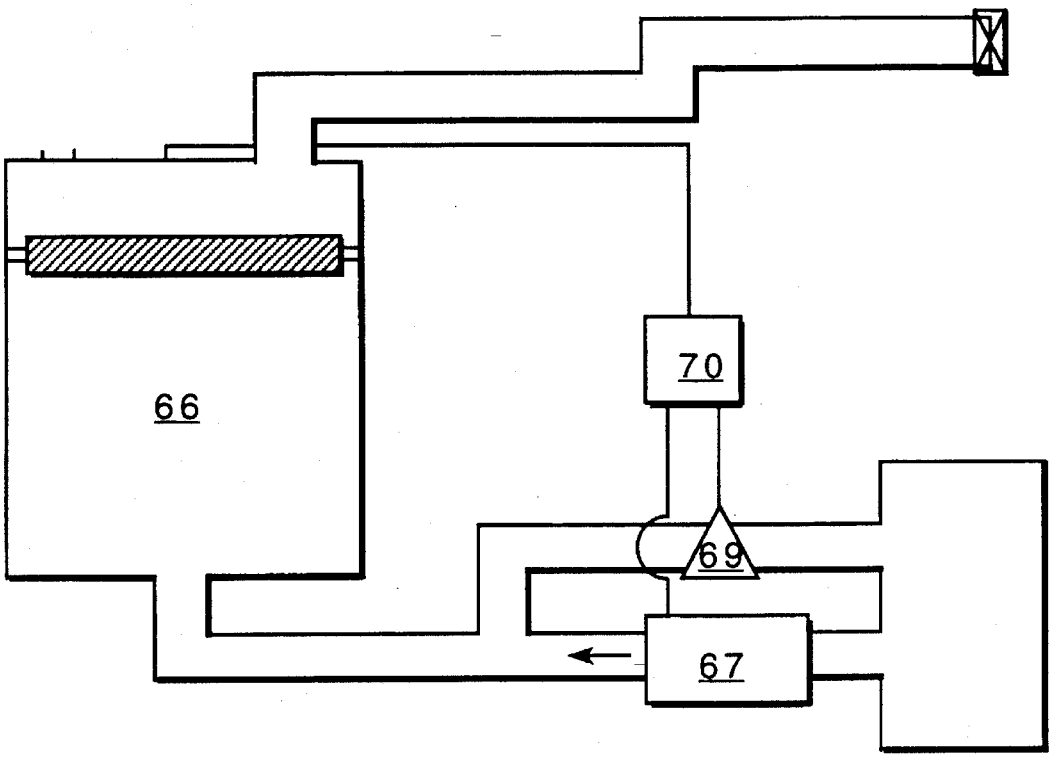
FIG. 3 is a schematic diagram of a variable-volume vehicle CNG tank.

The CNG dispensing system 8 may be used to fill, with no modifications, either of two types of vehicle tank. The first type is a conventional, fixed-volume vehicle tank 64. The second type 66, shown in FIG. 3, is a variable-volume vehicle tank having a separate hydraulic pump 67 and valve 69, both operated by an in-vehicle controller 70. The controller 70 in the vehicle maintains the pressure in the vehicle tank 66 at a constant 3000 psig.

Before a vehicle tank of either type is filled, the controller 12 measures and records first the signals generated by the level-sensing potentiometers 58*a,b*; 58*c,d* located within the two storage tanks 22*a,b*; 22*c,d* connected to the dispensing station 24, 26 to which the vehicle tank 64, 66 is attached. The vehicle tank 64, 66 will be filled from whichever of the two storage tanks 22*a,b*; 22*c,d* has the lowest indicated level. For example, as shown in FIG. 1, storage tank 22*b* contains less hydraulic fluid, and therefore more CNG, than tank 22*a*. Vehicle tank 64 would therefore be filled from storage tank 22*b*. Similarly, vehicle tank 66 would be filled from storage tank 22*c*.

The controller then samples the signal generated by a temperature sensor 72 positioned so as to measure ambient air temperature. Based on the indicated temperature reading, the controller determines the maximum fill pressure of the vehicle tanks 64, 66. Generally, the lower the ambient air temperature, the lower the maximum fill pressure. This avoids the need to vent CNG from the vehicle tanks 64, 66 should a subsequent ambient temperature rise cause the pressure of the CNG in the vehicle tanks 64, 66 to increase above the maximum vehicle tank pressure rating.

To fill the fixed-volume vehicle tank 64, the controller 12 first opens both valve 34 in the fill line 32 and valve 30*b*. As CNG flows into the vehicle tank 64, the pressure in the storage tank 22*b* falls rapidly until the pressures in the two tanks 64, 22*b* equalize. When the pressure in the storage tank 22*b* drops below the maximum fill pressure, the control interface causes valve 46*b* to open, and activates the hydraulic pump 50. As hydraulic fluid enters the storage tank 22*b*, the volume of the region containing CNG diminishes, increasing tank pressure and forcing CNG into the fixed-volume vehicle tank 64. When a small 5–10 gpm hydraulic pump 50 is used, the hydraulic fluid flow rate is insufficient to maintain the pressure in the storage tank 22*b* at the maximum fill pressure throughout the filling operation. Therefore, the CNG transfer from tank 22*b* into vehicle tank 64 proceeds until the pressure sensor 56*b* indicates that the pressure in the storage tank has risen above the maximum fill pressure. Valves 30*b* and 34 are then closed and the signal generated by the level-sensing potentiometer 58*b* compared to the initial reading to determine, through volume displacement, the total mass of CNG delivered to the vehicle tank 64.

Alternatively, a hydraulic pump 50 capable of delivering fluid at significantly greater flow rates could instead be used. During the filling operation, when the signal received from the pressure sensor 56*b* indicates that the pressure exceeds the maximum fill pressure, the control interface closes valve 46*b* and shuts off the hydraulic pump 50. If the indicated storage tank 22*b* pressure then drops below the maximum fill pressure, the vehicle tank 64 cannot be completely filled. The controller 12 then causes valve 46*b* to reopen and pump 50 to reactivate. This control scheme repeats until the indicated storage tank 22*b* pressure does not drop below the maximum fill pressure after valve 46*b* is closed and the pump 50 stopped. At this point the vehicle tank 64 must be filled, so valves 30*b* and 34 are closed and the total mass of dispensed CNG determined in the manner detailed above.

Figure 4:
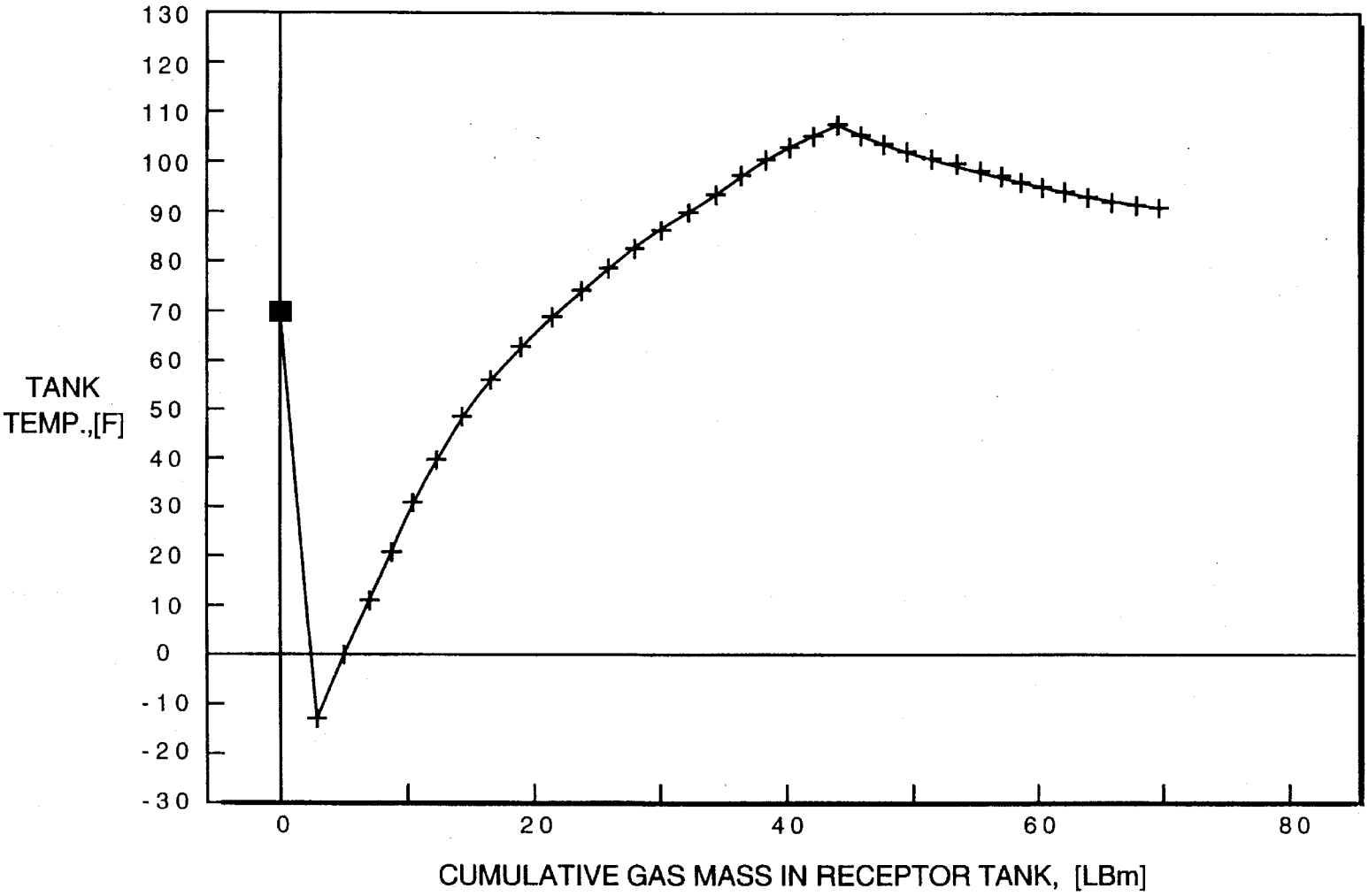
FIG. 4 is a graphical representation of the theoretical relationship between the cumulative mass of CNG transferred to a vehicle tank and temperature within that tank.

Throughout the filling operation, the dispensed CNG expands as it flows to the vehicle tank 64, becoming cooler. Simultaneously, the CNG entering the fixed-volume vehicle tank 64 further compresses, and therefore heats, any CNG already present there. Initially, the cooling effect dominates, and temperature within the vehicle tank 64 falls. For example, as shown in FIG. 4, if the ambient temperature before the filling operation begins is 70° F., in the early stages of the filling operation the temperature in the fixed-volume vehicle tank 64 falls to a low of −15° F.

However, as the pressure in the vehicle tank 64 rises, the entering CNG expands less, and the compression heating effect begins to dominate. For example, as shown in FIG. 4, immediately after the vehicle tank 64 is completely filled the temperature of the CNG there is between 90° and 100° F.

When the variable-volume vehicle tank 66 is to be filled from the other dispensing station 26, before the fill valve 35 opens, the pressure in that vehicle tank 66, irrespective of the amount of CNG stored there, is controlled to equal the maximum fill pressure. When the fill valve 35 and valve 30*c* are opened, no CNG therefore flows to the vehicle tank 66. Given this, to induce flow and overcome any "pumping losses" in the system, during filling, the controller 70 in the vehicle maintains the pressure in the vehicle tank at 5–10 psig below the maximum fill pressure. However, when the vehicle tank 66 is completely filled with CNG, the vehicle controller 70 will be unable to maintain the pressure at this point. The hydraulic pump 50 in the dispensing station 8, however, will continue to supply fluid through line 42*c* to the storage tank 22*c*. When the indicated pressure in the storage tank 22*c* rises above the maximum fill pressure, therefore, the variable-volume vehicle tank 66 must be filled. The controller 12 then causes valves 30*c* and 35 to close. The total mass and/or volume of CNG delivered to the vehicle tank 66 is then determined as described above.

Because the pressure drop between the storage tank 22*c* and the variable-volume vehicle tank 66 remains low and constant throughout the filling operation, CNG flowing to the vehicle tank 66 expands very little, resulting in only a limited cooling effect. Further, since the pressure in the variable-volume vehicle tank 66 is maintained constant throughout the filling operation, there is no compression heating effect. Theoretically, therefore, the temperature of the gas in the vehicle tank 66 will be the same immediately after filling as it was immediately before.

The invention embraces also alternative apparatus for determining the total mass of CNG delivered to a vehicle tank. For example, as shown in FIG. 2, a flow rate sensor 68*a–d* is included in each of the lines supplying hydraulic fluid to the storage tanks 22*a–d*. Since hydraulic fluid is substantially incompressible, these sensors can measure either mass or volume flow rate. By integrating the signals generated by these sensors 68*a–d*, the controller 12 determines the total mass or volume of CNG delivered to a vehicle tank during the filling operation.

If, after a vehicle tank 64, 66 has been filled, a storage tank 22*a–d* is depleted of CNG, that tank can be refilled in one of two ways. First, it can be refilled from the compressor 10 just as during the replenishing operation. The compressor 10 can fill one storage tank 22*a* while the tank 22*b* connected to the same dispensing station 24 simultaneously fills a vehicle tank 64. If, however, both storage tanks 22*a,b* connected to a single dispensing station 24 are empty, either or both of the two storage tanks 22*c,d* connected to the other dispensing station 26 can be used quickly to refill them. For example, if storage tank 22*d* is being used to fill a vehicle, and both tank 22*a* and 22*b* are empty, valves 20*b* and 20*c* can be opened. The controller then maintains the pressure in tank 22*c* at 3000 psig by opening valve 46*c* and activating the hydraulic pump 50. The controller 12 also maintains the pressure in tank 22*b* at 5–10 psi below 3000 psig by opening valve 44*b* to allow hydraulic fluid in tank 22*b* to drain to the reservoir, just as during the replenishing operation. Valves 20*b* and 20*c* are closed when the level-sensing potentiometers 58*b,c* in either tank 22*b* or 22*c* indicate that the desired amount of CNG has been transferred.

Figure 5:
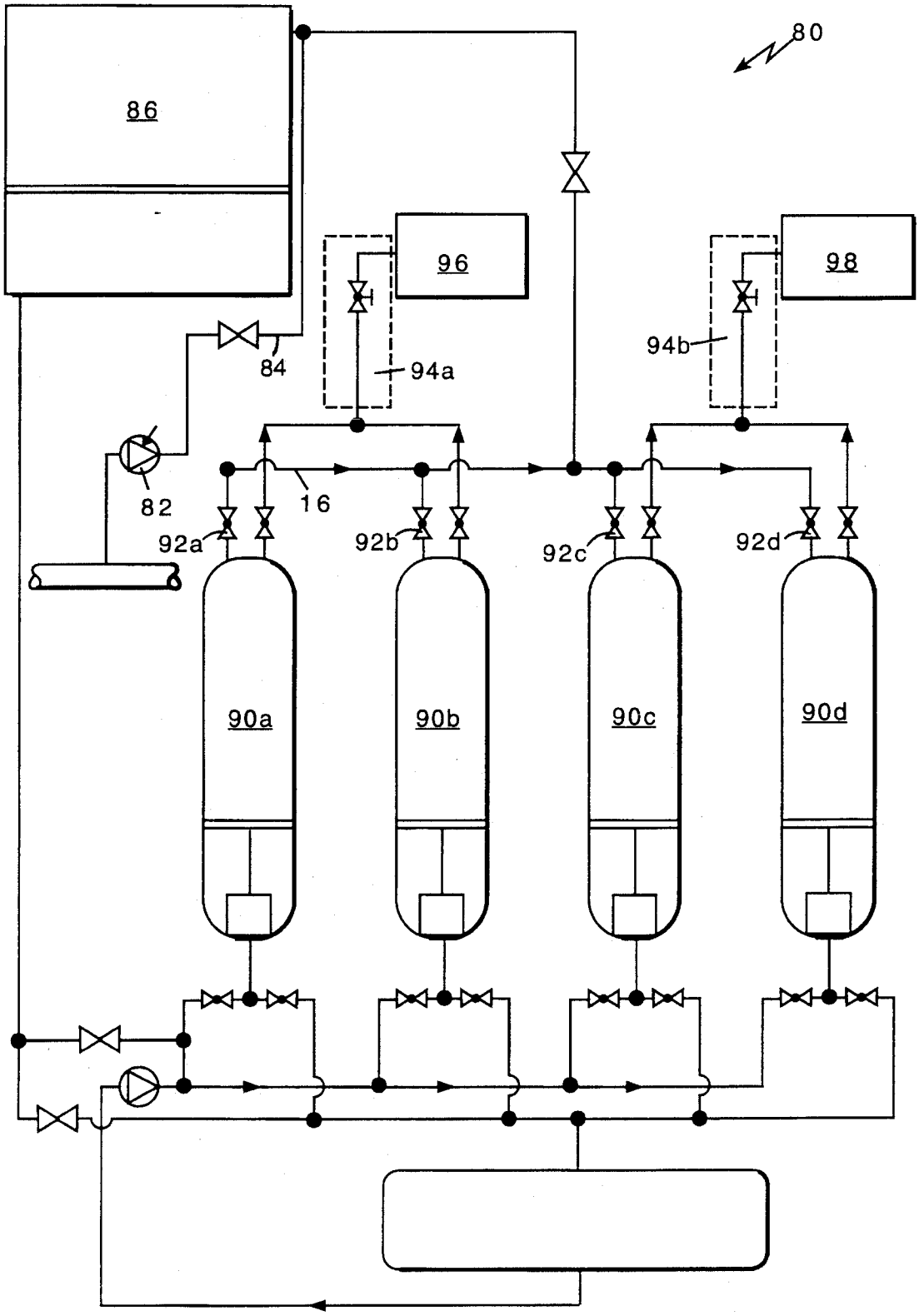
FIG. 5 is a schematic diagram of a third embodiment of a variable-volume CNG storage and dispensing apparatus.

An alternative CNG storage and dispensing system 80 is shown in FIG. 5. In this alternative embodiment, CNG is delivered from a compressor 82 through a valved delivery line 84 to a single large variable-volume storage tank 86. As with the variable-volume tanks described above, the flow of hydraulic fluid into and out of the large tank 86 is controlled to maintain a constant pressure of CNG there.

The large tank 86 connects through a valved transfer line 88 to a series of smaller variable-volume storage tanks 90*a–d*. A particular small storage tank is filled by opening both the valved transfer line 88 and the fill valve 92*a–d* associated with the small storage tank. Similar to the process described above in connection with the filling of a variable-volume vehicle tank, the controller maintains the pressure in the smaller storage tank at 5–10 psig below the pressure of the large storage tank 86. As with the CNG dispensing station 8 described above, two smaller storage tanks connect to each dispensing station 94*a,b*. Thus, one smaller tank can be replenished from the large storage tank 86 while a vehicle tank 96,98 is filled from the other small storage tank connected to the same dispensing station.

The maximum volume of each of these smaller storage tanks 90*a–d* approximately equals the volume of a single vehicle tank 96,98. Sizing the smaller storage tanks in this fashion reduces the amount of hydraulic energy needed to force the CNG into the vehicle tanks.

Referring to FIG. 1, despite the fact that some storage tanks 22*a–d* can be refilled while others are simultaneously dispensing CNG to vehicle tanks 64, 66, if the demand on the system 8 is sufficient, there will come a point where the system is unable to fill a vehicle tank in the allotted time period. Thus, a system 8 initially fully charged with CNG whose compressor system 10 operates continuously can at some point become completely depleted of CNG. Should this occur, the next vehicle tank will take longer than the allotted time period to fill.

The number of vehicle tanks (n) that can be "continuously filled" by the system with no interruption is determined with reference to the allotted fill time ($t_f$, in minutes), the allotted "idle time" between vehicle fills ($t_i$, in minutes), the maximum volume flow rate supplied by the compressor (c, in scfm), the maximum CNG storage volume of the storage tanks (s, in scf), the storage effectiveness (e), the maximum CNG storage volume of the vehicle tanks (v, in scf), and the number of dispensing stations (d). The theoretical maximum demand of the system is then determined by:

$$n = \frac{s \times e - \frac{c \times t_i}{d}}{v - (t_i + t_f) \times \frac{c}{d}} \tag{1}$$

In the two embodiments described above, $t_f$ equals 5 minutes, $t_i$ equals 2 minutes, c equals 200 scfm, s equals 24800 scf, e equals 1, v equals 1150, and d equals 2. Thus, a total of 55 vehicle tanks may be continuously filled from the two dispensing stations in these embodiments. The 56th tank will take longer than the allotted 7 minutes to fill.

Alternatively, equation (1) can be manipulated to determine, for a given estimate of the maximum anticipated fill demand (n), the requisite maximum compressor flow rate:

$$c = d \times \frac{n \times v - s \times e}{n \times (t_i - t_f) - t_i} \tag{2}$$

Should the hydraulic pump 50 fail, the system 8 remains operable to deliver CNG to vehicles. If a vehicle tank 64 is connected to the first dispensing station 24, the controller starts the compressor and causes either valves 20*a* and 30*a* or valves 20*b* and 30*b* to open. The compressor then delivers CNG at the maximum fill pressure directly to the vehicle. When the pressure sensor 56*a,b* in the tank 22*a,b* connected to the dispensing station indicates a pressure in excess of the maximum fill pressure, the vehicle tank 64 is deemed filled.

Similarly, if just the compressor 10 fails, the system 8 retains limited operability. Just as in the normal filling operation, all CNG stored in the storage tanks 22*a–d* prior to the compressor failure can still be delivered to vehicle tanks.

Other embodiments are within the claims.

What is claimed is:

1. A CNG refueling station for recharging vehicle tanks with CNG to a predetermined pressure level, comprising:

at least one stationary variable-volume ground storage vessel at the site of said refueling station designed to withstand said predetermined pressure and capable of holding a supply of gas sufficient for multiple refillings of vehicle tanks;

an on-site dispensing station at said refueling station providing a connection head for temporary sealed gaseous interconnection with a vehicle tank;

a valved pressurized gas supply line connected between said storage vessel and a natural gas source for replenishing said supply of gas;

a valved gas delivery line extending from said storage vessel to said dispensing station;

a volume sensor for continuously determining the volume of said storage vessel; and a controller responsive to the pressure of gas contained in said storage vessel for varying the volume of said storage vessel while displacing gas out of said storage vessel through said delivery line, and responsive to said volume sensor for activating said gas supply line and responsive to the pressure of gas contained in said storage vessel for varying the volume of said storage vessel while said gas supply line replenishes said supply of gas.

2. The apparatus of claim 1 wherein the maximum volume flow rate through said valved pressurized gas supply line at said predetermined pressure level is a function of the number of vehicle tanks to be continuously filled by said station, the maximum time within which each vehicle tank must be completely filled, the allotted "idle time" between vehicle fills, the maximum volume of the variable-volume storage vessel, the storage effectiveness, the maximum volume of each vehicle tank, and the number of dispensing stations.

3. The apparatus of claim 2 wherein the maximum volume flow rate c at said predetermined pressure level through said valved pressurized gas supply line is given generally by:

$$c = d \times \frac{n \times v - s \times e}{n \times (t_i + t_f) - t_i} \quad (3)$$

where n is the number of vehicle tanks that can be continuously filled by said station, $t_f$ is the maximum time in minutes within which each vehicle tank must be completely filled, $t_i$ is the allotted "idle time" in minutes between vehicle fills, s is the maximum volume in scf of the variable-volume storage vessel, e is the storage effectiveness, v is the maximum volume in scf of each vehicle tank, and d is the number of dispensing stations.

4. The apparatus of claim 1 wherein said variable-volume storage vessel comprises a storage tank connected to a valved pressurized working fluid supply line.

5. The apparatus of claim 4 wherein said working fluid is a desiccant liquid.

6. The apparatus of claim 4 wherein said volume sensor is a level-sensing potentiometer connected to a float located within said storage tank.

7. The apparatus of claim 4 wherein said volume sensor determines the flow rate of working fluid through said working fluid supply line.

8. The apparatus of claim 4 wherein said volume sensor is a sonic linear transducer.

9. The apparatus of claim 4 wherein said volume sensor measures the weight of said storage vessel.

10. The apparatus of claim 4 wherein said tank further includes:

a substantially impermeable and movable interface separating the portion of said tank occupied by said working fluid from the portion of said tank occupied by said supply of gas.

11. The apparatus of claim 10 wherein said volume sensor is a level-sensing potentiometer connected to said interface.

12. The apparatus of claim 10 wherein said volume sensor determines the flow rate of working fluid through said working fluid supply line.

13. The apparatus of claim 1 wherein said refueling station comprises first and second variable-volume storage vessels respectively connected by first and second valved gas delivery lines to said dispensing station.

14. The apparatus of claim 13 and further including:

a valved transfer line connecting said first and second storage vessels.

15. The apparatus of claim 14 wherein said controller is further responsive to the volume of said first and second storage vessels for activating said transfer line to replenish said gas supply within said first storage vessel.

16. A CNG refueling station for recharging vehicle tanks with CNG to a predetermined pressure level, comprising:

a first stationary variable-volume ground storage vessel at the site of said refueling station designed to withstand said predetermined pressure and capable of holding a supply of gas sufficient for multiple refillings of vehicle tanks;

a second stationary variable-volume ground storage vessel at the site of said refueling station designed to withstand said predetermined pressure and capable of holding a supply of gas generally sufficient for a single refilling of a vehicle tank;

an on-site dispensing station at said refueling station providing a connection head for temporary sealed gaseous interconnection with a vehicle tank;

a valved pressurized gas supply line connected between said first storage vessel and a natural gas source for replenishing said supply of gas by charging said first storage vessel with gas at said predetermined pressure level when said gas supply line is activated;

a valved gas transfer line connecting said first and second storage vessels for transferring gas from said first storage vessel to said second storage vessel when said gas transfer line is activated;

a valved gas delivery line extending from said second storage vessel to said dispensing station; and a controller responsive to the pressure of gas contained in said second storage vessel for varying the volume of said storage vessel while displacing gas out of said second storage vessel through said delivery line, and responsive to the volume of said first storage vessel for activating said gas supply line.

17. The apparatus of claim 16 wherein said controller is further responsive to the volume of said second storage vessel for activating said gas transfer line.

18. The apparatus of claim 17 wherein said controller maintains a substantially constant pressure drop across said gas transfer line when said gas transfer line is activated.

19. The apparatus of claim 16 and further including:

a volume sensor for determining the volume of said first storage vessel.

20. The apparatus of claim 16 and further including:

a volume sensor for determining the volume of said second storage vessel.

21. A CNG refueling station for recharging vehicle tanks with CNG to a predetermined pressure level, comprising:

at least one stationary ground storage tank at the site of said refueling station designed to withstand said predetermined pressure and capable of holding a supply of gas sufficient for multiple refillings of vehicle tanks;

a valved pressurized working fluid supply line connected between said storage tank and a source of desiccant liquid for supplying desiccant liquid to said storage tank when said working fluid supply line is activated;

an on-site dispensing station at said refueling station providing a connection head for temporary sealed gaseous interconnection with a vehicle tank;

a valved pressurized gas supply line connected between said storage tank and a natural gas source for replenishing said supply of gas by charging said storage tank with gas at said predetermined pressure level when said gas supply line is activated;

a valved gas delivery line extending from said storage tank to said dispensing station;

a volume sensor for continuously determining the volume of said storage tank; and a controller responsive to the pressure of gas contained in said storage tank for varying the volume of said storage tank while displacing gas out of said storage tank through said delivery line, and responsive to said volume sensor for activating said gas supply line.

22. A CNG refueling station for recharging vehicle tanks with CNG, comprising:

at least one variable-volume storage vessel for holding a supply of gas at a pressure;

a dispensing station providing a connection head for temporary sealed gaseous interconnection with a vehicle tank;

a gas supply line connected between said storage vessel and a natural gas source for replenishing said supply of gas;

a valved gas delivery line extending from said storage vessel to said dispensing station;

a volume sensor for continuously determining the volume of said storage vessel; and a controller responsive to the pressure of gas contained in said storage vessel for varying the volume of said storage vessel while displacing gas out of said storage vessel through said delivery line, and responsive to said volume sensor for activating said gas supply line and responsive to the pressure of gas contained in said storage vessel for varying the volume of said storage vessel while said gas supply line replenishes said supply of gas.

* * * * *